US010865690B2

(12) United States Patent
Butler et al.

(10) Patent No.: US 10,865,690 B2
(45) Date of Patent: Dec. 15, 2020

(54) SENSOR TABLE FOR SINGLE UNIT AFTERTREATMENT SYSTEM

(71) Applicant: Cummins Emission Solutions, Inc., Columbus, IN (US)

(72) Inventors: Eric R. Butler, Madison, WI (US); Andrew Komisarek, Janesville, WI (US); William J. Runde, Janesville, WI (US)

(73) Assignee: Cummins Emission Solutions, Inc., Columbus, IN (US)

( * ) Notice: Subject to any disclaimer, the term of this patent is extended or adjusted under 35 U.S.C. 154(b) by 14 days.

(21) Appl. No.: 16/216,747

(22) Filed: Dec. 11, 2018

(65) Prior Publication Data

US 2019/0120114 A1 Apr. 25, 2019

Related U.S. Application Data

(63) Continuation of application No. 15/305,061, filed as application No. PCT/US2015/027508 on Apr. 24, 2015, now Pat. No. 10,156,177.

(Continued)

(51) Int. Cl.
*F01N 3/021* (2006.01)
*F01N 3/20* (2006.01)

(Continued)

(52) U.S. Cl.
CPC ..... *F01N 13/008* (2013.01); *F01N 3/021* (2013.01); *F01N 3/2066* (2013.01);

(Continued)

(58) Field of Classification Search
CPC ..... F01N 3/021; F01N 3/2066; F01N 11/002; F01N 11/007; F01N 13/008;

(Continued)

(56) References Cited

U.S. PATENT DOCUMENTS 6,032,538 A 3/2000 Rickman et al.
7,192,463 B2 3/2007 Shutty et al.

(Continued)

FOREIGN PATENT DOCUMENTS

CN 101952133 A 1/2011
CN 102758670 A 10/2012

(Continued)

OTHER PUBLICATIONS

First Office Action issued for Chinese Patent Application No. 2015800217463, dated Mar. 30, 2018, 19 pages.

(Continued)

*Primary Examiner* — Audrey K Bradley
(74) *Attorney, Agent, or Firm* — Foley & Lardner LLP

(57) ABSTRACT

A sensor mounting table for mounting sensors to an aftertreatment system may include a sensor mounting plate having a substantially flat mounting surface for mounting one or more sensors associated with the aftertreatment system. The substantially flat mounting surface may be offset from a heat shield of the aftertreatment system. The sensor mounting table may further include an insulative material disposed between at least a portion of the substantially flat mounting surface of the sensor mounting plate and the heat shield. The sensor mounting plate may be configured to be attached to the aftertreatment system to secure the insulative material between the substantially flat mounting surface of the sensor mounting plate and the heat shield.

9 Claims, 10 Drawing Sheets

Related U.S. Application Data

(60) Provisional application No. 61/985,240, filed on Apr. 28, 2014.

(51) Int. Cl.

| | |
|---|---|
| ***F01N 11/00*** | (2006.01) |
| ***F01N 13/00*** | (2010.01) |
| ***F01N 13/14*** | (2010.01) |
| ***F01N 13/18*** | (2010.01) |

(52) U.S. Cl.

CPC ..... *F01N 11/002* (2013.01); *F01N 11/007* (2013.01); *F01N 13/148* (2013.01); *F01N 13/18* (2013.01); *F01N 2260/20* (2013.01); *F01N 2560/026* (2013.01); *F01N 2560/05* (2013.01); *F01N 2560/06* (2013.01); *F01N 2560/08* (2013.01)

(58) Field of Classification Search

CPC .... F01N 13/148; F01N 13/18; F01N 2260/20; F01N 2560/026; F01N 2560/05; F01N 2560/06; F01N 2560/08

See application file for complete search history.

(56) References Cited

U.S. PATENT DOCUMENTS

| | | | | |
|---|---|---|---|---|
| 7,966,979 | B2 | 6/2011 | Olsen et al. | |
| 8,341,949 | B2 | 1/2013 | Tarabulski | |
| 9,217,355 | B2 | 12/2015 | Boahene et al. | |
| 9,382,832 | B2 | 7/2016 | Bowers | |
| 2005/0005773 | A1 | 1/2005 | Shutty et al. | |
| 2007/0163765 | A1 | 7/2007 | Rondier et al. | |
| 2008/0121451 | A1 | 5/2008 | Kertz et al. | |
| 2010/0031644 | A1 | 2/2010 | Keane et al. | |
| 2011/0005853 | A1 | 1/2011 | Kamiya | |
| 2011/0099978 | A1 | 5/2011 | Davidson et al. | |
| 2012/0273648 | A1 | 11/2012 | Maske et al. | |
| 2013/0145820 | A1 | 6/2013 | Boahene et al. | |
| 2013/0164182 | A1 | 6/2013 | Iijima et al. | |
| 2013/0330237 | A1 | 12/2013 | Lamps et al. | |
| 2014/0104048 | A1 | 4/2014 | De Kock et al. | |
| 2014/0373721 | A1* | 12/2014 | Sandou | F01N 3/0211 96/421 |
| 2015/0000389 | A1 | 1/2015 | Runde et al. | |
| 2015/0059457 | A1 | 3/2015 | Niaz | |
| 2016/0369940 | A1 | 12/2016 | Patil et al. | |
| 2017/0184004 | A1 | 6/2017 | Butler et al. | |

FOREIGN PATENT DOCUMENTS

| | | | | |
|---|---|---|---|---|
| DE | 10 2007 054 066 | A1 | 5/2008 | |
| DE | 10201060071 | | 5/2012 | |
| EP | 2 568 139 | A1 | 3/2013 | |
| WO | WO-2012/096513 | | 7/2012 | |
| WO | WO-2012096513 | A2 * | 7/2012 | F01N 13/008 |

OTHER PUBLICATIONS

International Search Report and Written Opinion for PCT/US2015/027508, dated Jul. 28, 2015, 12 pages.

Examination Report for U.K. Patent App. No. 1617783.4 dated Nov. 11, 2019, 4 pages.

Extended European Search Report for European Patent App. No. 14174823.6 dated Oct. 14, 2018, 8 pages.

Extended European Search Report for European Patent App. No. 16189819.2 dated Mar. 6, 2017, 8 pages.

International Search Report & Written Opinion for PCT/US2020/012546 dated Apr. 2, 2020, 12 pages.

Office Action for European Patent App. No. 16189819.2 dated Dec. 22, 2017, 8 pages.

Office Action for U.S. Appl. No. 14/317,680 dated Jun. 28, 2016, 10 pages.

* cited by examiner

SENSOR TABLE FOR SINGLE UNIT AFTERTREATMENT SYSTEM

CROSS-REFERENCE TO RELATED APPLICATIONS

The present Application is a continuation of patent application Ser. No. 15/305,061, filed Oct. 18, 2016, which is a U.S. National Stage Application of PCT Application No. PCT/US2015/027508, filed on Apr. 24, 2015, which claims priority to U.S. Provisional Application No. 61/985,240, filed on Apr. 28, 2014 The contents of all three applications are incorporated herein by reference in their entireties.

TECHNICAL FIELD

The present application relates generally to the field of selective catalytic reduction (SCR) systems for an exhaust system. More specifically, the present application relates to sensor mounting configurations for selective catalytic reduction (SCR) systems.

BACKGROUND

For internal combustion engines, such as diesel engines, nitrogen oxide ($NO_x$) compounds may be emitted in the exhaust. To reduce $NO_x$ emissions, a SCR process may be implemented to convert the $NO_x$ compounds into more neutral compounds, such as diatomic nitrogen, water, or carbon dioxide, with the aid of a catalyst and a reductant. The catalyst may be included in a catalyst chamber of an exhaust system, such as that of a vehicle or power generation unit. A reductant, such as anhydrous ammonia, aqueous ammonia, or urea is typically introduced into the exhaust gas flow prior to the catalyst chamber. To introduce the reductant into the exhaust gas flow for the SCR process, an SCR system may dose or otherwise introduce the reductant through a dosing module that vaporizes or sprays the reductant into an exhaust pipe of the exhaust system up-stream of the catalyst chamber. The SCR system may include one or more sensors to monitor conditions within the exhaust system.

SUMMARY

A sensor mounting table for mounting sensors to an aftertreatment system may include a sensor mounting plate having a substantially flat mounting surface for mounting one or more sensors associated with the aftertreatment system. The substantially flat mounting surface may be offset from a heat shield of the aftertreatment system. The sensor mounting table may further include an insulative material disposed between at least a portion of the substantially flat mounting surface of the sensor mounting plate and the heat shield. The sensor mounting plate may be configured to be attached to the aftertreatment system to secure the insulative material between the substantially flat mounting surface of the sensor mounting plate and the heat shield.

BRIEF DESCRIPTION OF THE DRAWINGS

The details of one or more implementations are set forth in the accompanying drawings and the description below. Other features, aspects, and advantages of the disclosure will become apparent from the description and the drawings, in which.

Figure 1:
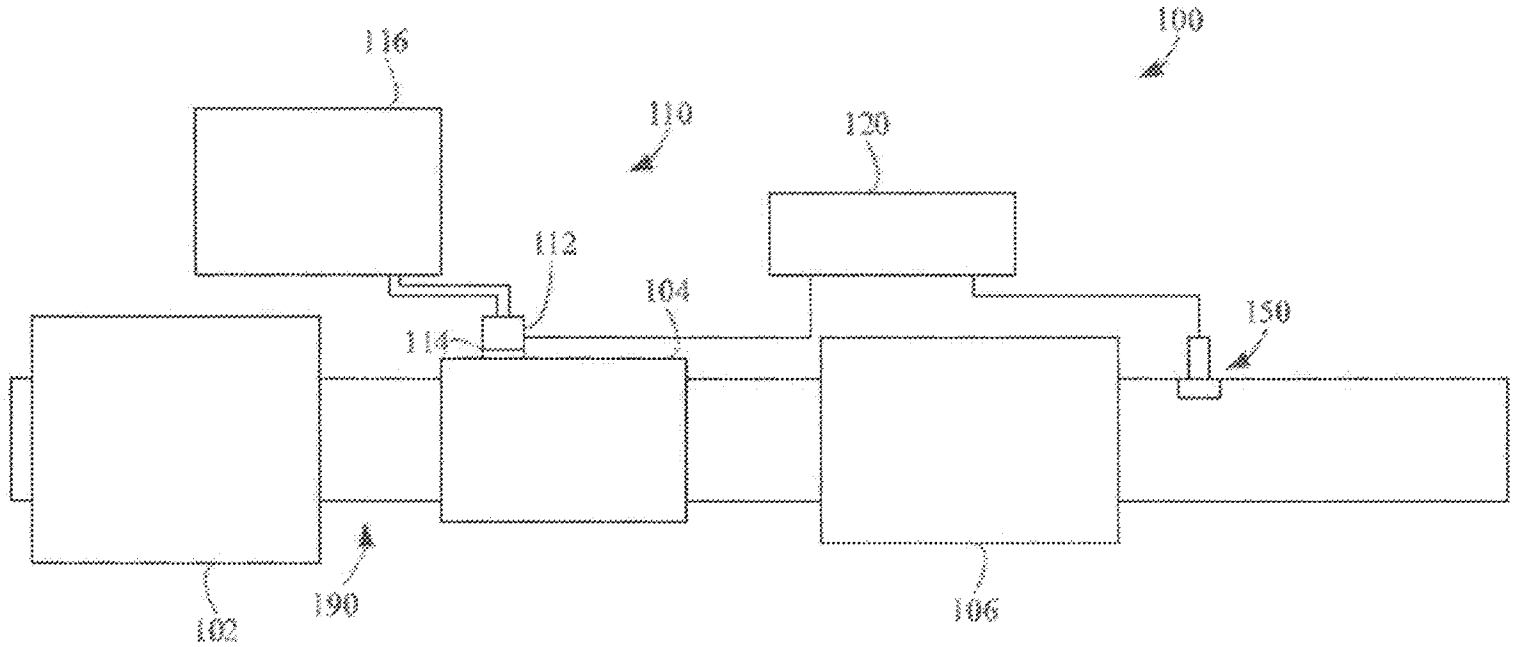
FIG. 1 depicts a block schematic diagram of an implementation of a aftertreatment system having an example reductant delivery system for an exhaust system.

It will be recognized that some or all of the figures are schematic representations for purposes of illustration. The figures are provided for the purpose of illustrating one or more implementations with the explicit understanding that they will not be used to limit the scope or the meaning of the concepts disclosed herein.

DETAILED DESCRIPTION

Following below are more detailed descriptions of various concepts related to, and implementations of, methods, apparatuses, and systems for sensor mounting tables to secure one or more sensors to an aftertreatment system. Examples of specific implementations and applications are provided primarily for illustrative purposes.

I. Overview

In some vehicles, an aftertreatment system is used to remove and/or reduce potentially unwanted elements within the exhaust of a vehicle. In some implementations, the aftertreatment system may comprise several distinct different components, such as a diesel particulate filter (DPF), a decomposition chamber or reactor, a SCR catalyst, and/or a diesel oxidation catalyst. Each of these components may be located at different, spaced out positions of the exhaust system such that one or more sensors associated with the different components are separately mounted to each different component.

However, in some vehicles, the aftertreatment system may be desired to be reduced in size. In such implementations, a single module system may combine the diesel particulate filter, decomposition reaction chamber or pipe, and the SCR catalyst into a single unit. As a result, instead of mounting the various sensors to the different components, this creates an issue with the sensors needing to be mounted on a single unit instead of several.

Accordingly, a sensor mounting apparatus for mounting all the sensors to the single unit may accommodate the sensors. Further, combining all the sensors, such as a DPF/SCR combined exhaust gas temperature sensor (EGTS), a DPF Delta Pressure (DP) sensor, an outlet $NO_x$ sensor, a particulate matter (PM) sensor, along with a combined wiring harness such that a single unit provides a complete package of sensors for the aftertreatment system. Making the sensor mounting apparatus more easily packaged may reduce costs when upgrading or replacing the sensors. Furthermore, a complete sensor mounting apparatus may minimize the material and complexity for mounting the sensors for such a single unit system.

Moreover, a low profile solution may assist with sensor mounting and/or cooling. For instance, the complete sensor mounting apparatus may include integrated insulation or cooling features. Reducing a direct heat path to the sensors and integrating the insulation may lower heat transfer to the sensors as well as reducing the profile of the complete sensor mounting apparatus. Furthermore, integrated wiring management and sensor orientation control may protect the sensors and wiring from damage by having a predictable configuration for the system.

Accordingly, a single or double sensor mounting table design to house the sensors for a single unit aftertreatment system may be provided for an aftertreatment system. A single module system may combine the sensors and wiring from the Diesel Particulate Filter (DPF), decomposition reaction chamber or pipe, and/or the SCR system. Such a new system may include a DPF/SCR combined EGTS, a DPF DP sensor, an outlet $NO_x$ sensor, and/or PM sensor along with a combined wiring harness for a urea injection module and any or all of the aforementioned sensors.

While the foregoing has generally described some advantageous aspects of the concepts presented herein, specific configurations for the concepts will be described in greater detail below. The various concepts introduced above and discussed in greater detail below may be implemented in any of numerous ways, as the described concepts are not limited to any particular manner of implementation.

II. Overview of Aftertreatment System

FIG. 1 depicts an aftertreatment system 100 having an example reductant delivery system 110 for an exhaust system 190. The aftertreatment system 100 includes a diesel particulate filter (DPF) 102, the reductant delivery system 110, a decomposition chamber or reactor 104, a SCR catalyst 106, and an example sensor 150.

The DPF 102 is configured to remove particulate matter, such as soot, from exhaust gas flowing in the exhaust system 190. The DPF 102 includes an inlet, where the exhaust gas is received, and an outlet, where the exhaust gas exits after having particulate matter substantially filtered from the exhaust gas and/or converting the particulate matter into carbon dioxide.

The decomposition chamber 104 is configured to convert a reductant, such as urea or diesel exhaust fluid (DEF), into ammonia. The decomposition chamber 104 includes a reductant delivery system 110 having a dosing module 112 configured to dose the reductant into the decomposition chamber 104 in some implementations, the urea, aqueous ammonia, DEF is injected upstream of the SCR catalyst 106. The reductant droplets then undergo the processes of evaporation, thermolysis, and hydrolysis to form gaseous ammonia within the exhaust system 190. The decomposition chamber 104 includes an inlet in fluid communication with the DPF 102 to receive the exhaust gas containing NOx emissions and an outlet for the exhaust gas, NOx emissions, ammonia, and/or remaining reductant to flow to the SCR catalyst 106.

The decomposition chamber 104 includes the dosing module 112 mounted to the decomposition chamber 104 such that the dosing module 112 may dose a reductant, such as urea, aqueous ammonia, or DEF, into the exhaust gases flowing in the exhaust system 190. The dosing module 112 may each include an insulator 114 interposed between a portion of the dosing module 112 and the portion of the decomposition chamber 104 to which the dosing module 112 is mounted. The dosing module 112 is fluidly coupled to one or more reductant sources 116. In some implementations, a pump (not shown) may be used to pressurize the reductant source 116 for delivery to the dosing module 112.

The dosing module 112 is also electrically or communicatively coupled to a controller 120. The controller 120 is configured to control the dosing module 112 to dose reductant into the decomposition chamber 104. The controller 120 may include a microprocessor, an application-specific integrated circuit (ASIC), a field-programmable gate array (FPGA), etc., or combinations thereof. The controller 120 may include memory which may include, but is not limited to, electronic, optical, magnetic, or any other storage or transmission device capable of providing a processor, ASIC, FPGA, etc. with program instructions. The memory may include a memory chip, Electrically Erasable Programmable Read-Only Memory (EEPROM), erasable programmable read only memory (EPROM), flash memory, or any other suitable memory from which the controller 120 can read instructions. The instructions may include code from any suitable programming language.

The SCR catalyst 106 is configured to assist in the reduction of NOx emissions by accelerating a NOx reduction process between the ammonia and the NOx of the exhaust gas into diatomic nitrogen, water, and/or carbon dioxide. The SCR catalyst 106 includes inlet in fluid communication with the decomposition chamber 104 from which exhaust gas and reductant is received and an outlet in fluid communication with an end of the exhaust system 190.

The exhaust system 190 may further include a diesel oxidation catalyst (DOC) in fluid communication with the exhaust system 190 (e.g., downstream of the SCR catalyst 106 or upstream of the DPF 102) to oxidize hydrocarbons and carbon monoxide in the exhaust gas.

One or more sensors 150 may be positioned at various portions of the exhaust system 190 to detect one or more emissions or conditions within the exhaust flow. For example, a NOx sensor 150, a CO sensor 150, and/or a particulate matter sensor 150 may be positioned downstream and/or upstream of the SCR catalyst 106, the decomposition chamber 104, and/or the DPF 102 to detect NOx, CO, and/or particulate matter within the exhaust gas of the exhaust system 190 of a vehicle. Such emission sensors 150 may be useful to provide feedback to the controller 120 to modify an operating parameter of the aftertreatment system 100 and/or the engine of the vehicle. For example, a NOx sensor may be utilized to detect the amount of NOx exiting the vehicle exhaust system and, if the NOx detected is too high or too low, the controller 120 may modify an amount of reductant delivered by the dosing module 112 and/or one or more aspects of the aftertreatment system 100 and/or engine. A CO and/or a particulate matter sensor may also be utilized to modify one or more aspects of the aftertreatment system 100 and/or engine.

III. Implementations of Sensor Tables

Figure 2:
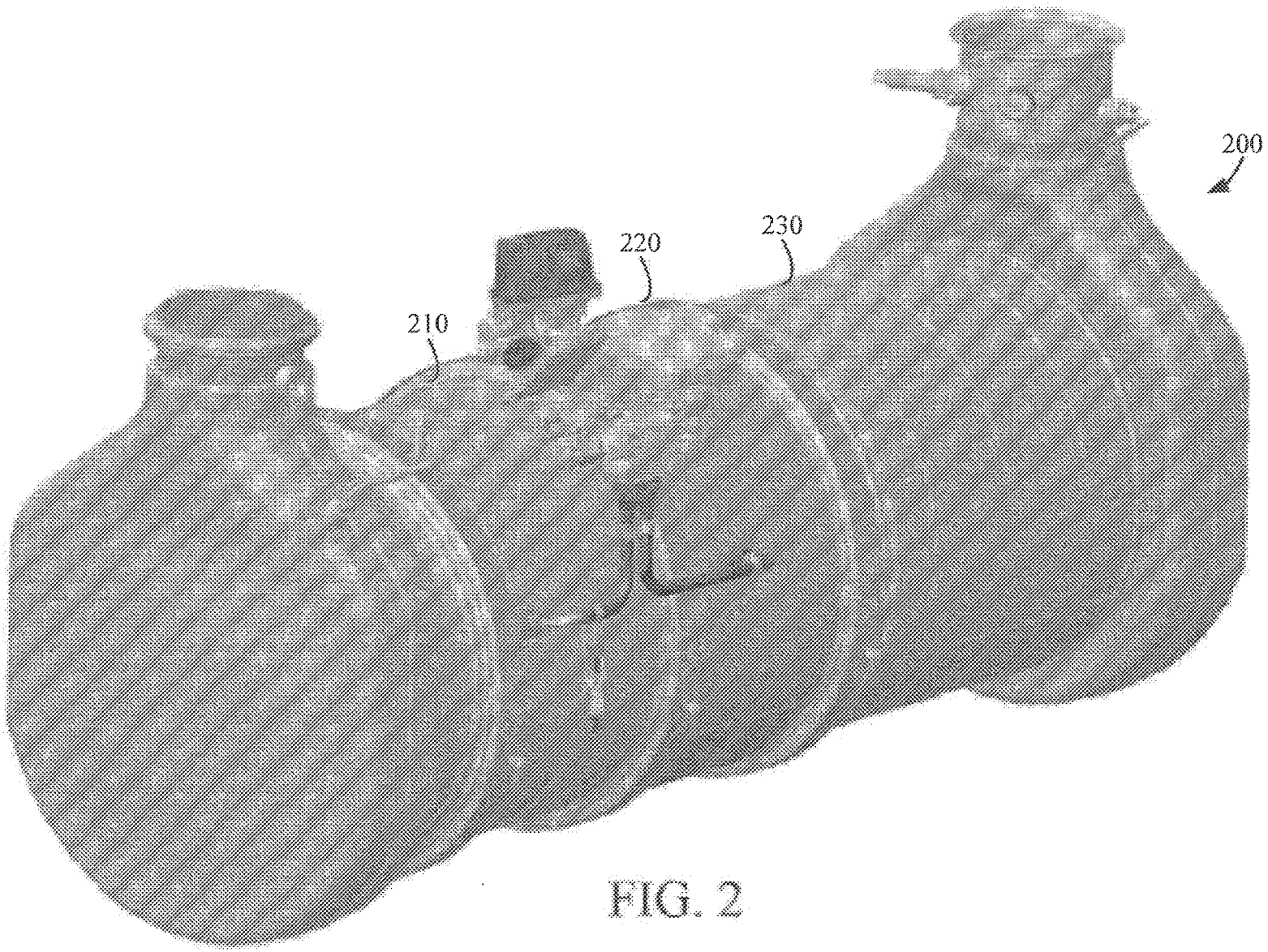
FIG. 2 depicts a perspective view of an implementation of a single unit aftertreatment system.
Figure 3:
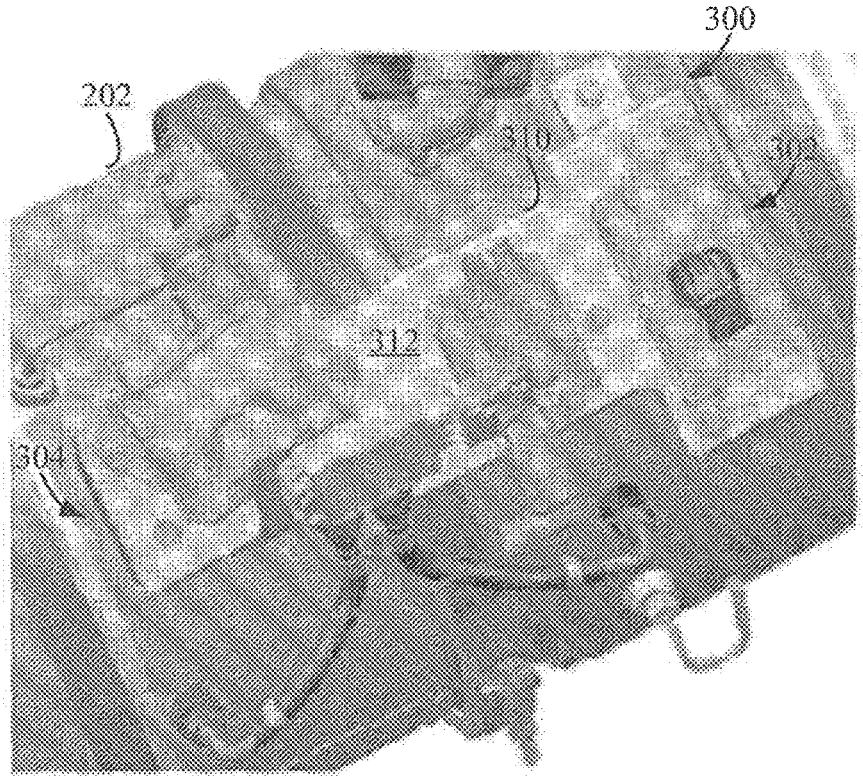
FIGS. 3-4 depict perspective views of an implementation of a sensor mounting table having a single table spanning a portion of the aftertreatment system with an insulation channel.
Figure 4:
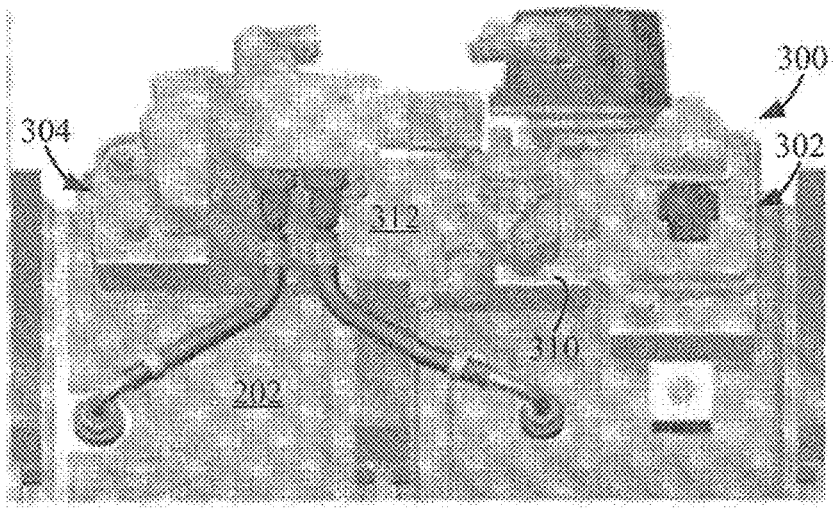

FIG. 2 depicts a single unit aftertreatment system 200 that combines a DPF 210, a decomposition reaction chamber or pipe 220, and a SCR catalyst 230 into one unit. The single module system 200 takes the former three subcomponents and combines them into one fully assembled unit 200 as shown in FIG. 2. As a result, the sensors and wiring from the DPF 210, decomposition reaction chamber or pipe 220, and the SCR catalyst 230 may need to be integrated into a single system for mounting to the single unit aftertreatment system 200.

FIGS. 3-7 depict a first implementation of a sensor mounting table 300 for mounting the sensors and wiring from the DPF 210, decomposition reaction chamber or pipe 220, and the SCR catalyst 230 to the aftertreatment system 200. The sensors may include a DPF/SCR combined EGTS, a DPF DP sensor, an outlet $NO_x$ sensor, and/or a PM sensor, along with a combined wiring harness. FIGS. 3-7 depict a single sensor mounting table 300 spanning a portion of the aftertreatment system 200. The sensor mounting table 300 includes a sensor mounting plate 310 having a substantially flat mounting surface 312 for mounting one or more sensors. The substantially flat mounting surface 312 of the sensor mounting plate 310 may be offset from a heat shield 202 of the aftertreatment system 200 to form a gap or insulation channel 390 therebetween (shown in FIG. 7). In some implementations, an insulative material 392 may be disposed between at least a bottom surface portion of the substantially flat mounting surface 312 of the sensor mounting plate 310 and the heat shield 202. The sensor mounting plate 300 may be configured to be attached to the aftertreatment system 200, such as via a threaded member threading into a portion of the aftertreatment system 200, to secure the insulative material 392 between the substantially flat mounting surface 312 of the sensor mounting plate 310 and the heat shield 202.

In some implementations, the sensor mounting plate 310 may be a single sheet metal stamping having one or more 90 degree bends to form a channel or a gap 390 between the sensor mounting plate 310 and the heat shield 202, which may house integrated insulation 392 between the sensor mounting plate 310 and the heat shield 202. The 90 degree bends may be substantially perpendicular to the substantially flat mounting surface 312 such that the one or more 90 degree bends secure the insulative material 392 between the sensor mounting plate 310 and the heat shield 202 in at least one direction, such as a longitudinal or lateral direction relative to the aftertreatment system 200. In some implementations, the stamping may be optimized for sensor mounting and wire routing.

Figure 5:
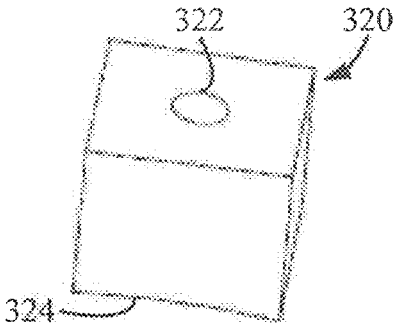
FIG. 5 depicts an implementation of a threaded standoff for mounting the sensor mounting table of FIGS. 3-4.
Figure 6:
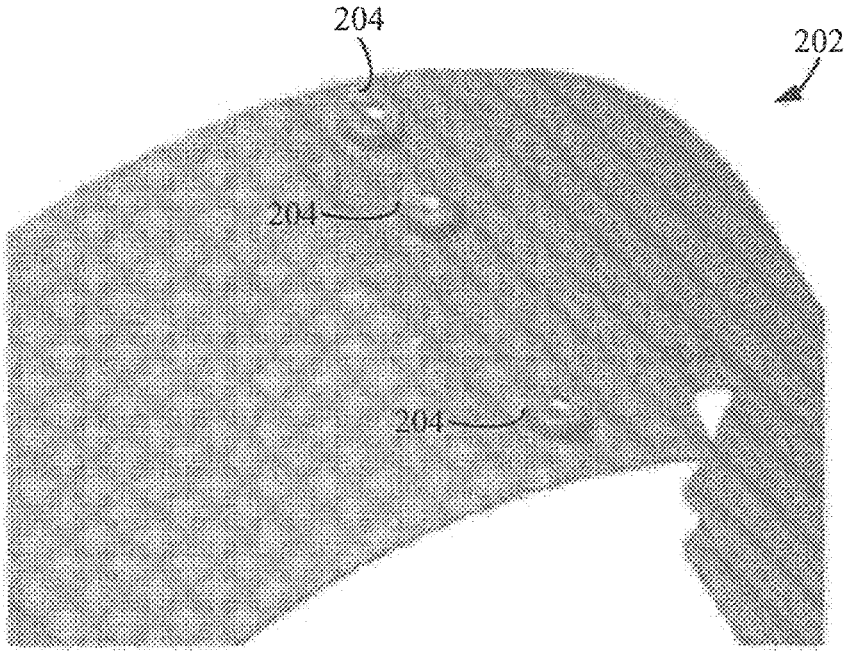
FIG. 6 depicts an implementation of a sump with one or more weld nuts for mounting the sensor mounting table of FIGS. 3-4.
Figure 7:
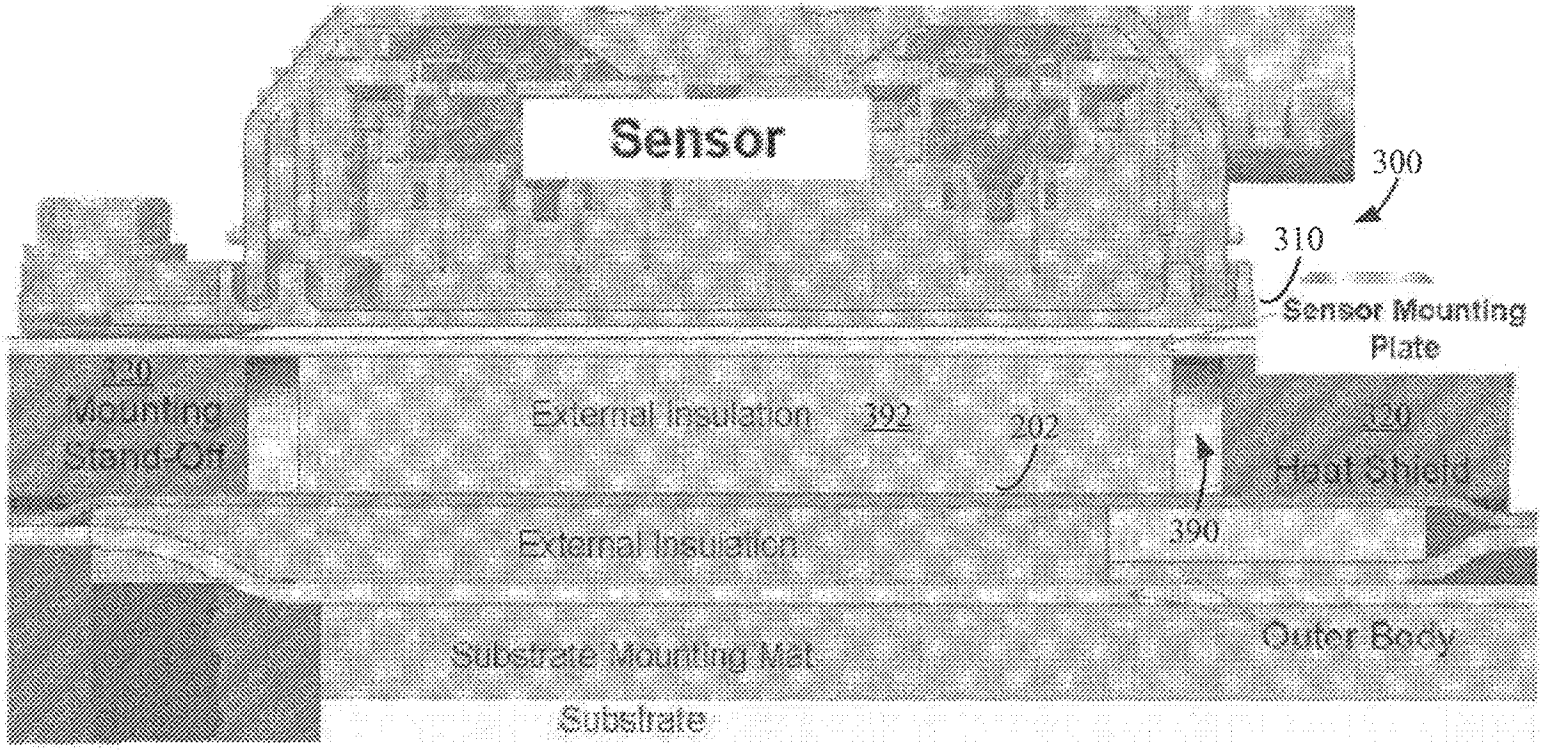
FIG. 7 depicts a cross-sectional elevation view of the sensor mounting table of FIGS. 3-4 mounted to a single, unit aftertreatment system.

Mounting standoffs 320, an example of which is shown in FIG. 5, may be positioned substantially at a first end 302 and a second end 304 of the sensor mounting table 300 to form the gap 390 shown in FIG. 7. In some implementations, the mounting standoffs 320 may be threaded and/or may be welded to the heat shield 202 and/or to the mounting plate 310. The mounting standoffs 320 may have an opening 322 formed through the mounting standoff 320 through which an attachment member, such as a bob, screw, etc. may be inserted to couple the sensor mounting plate 300 to the heat shield 202. In some implementations, a side of the mounting standoff 320 may be curved, such as a concave curve 324, to substantially conform to a curvature of the heat shield 202.

In other implementations, the sensor mounting plate 310 may be attached directly to the heat shield 202. In such an arrangement, such as that shown in FIG. 6, the heat shield 202 may include stamped sumps 204 with welded nuts or standoffs welded to the heat shield 202. The stamped sumps 204 may be stamped into the heat shield 202 as the heat shield 202 is being formed and may have the welded nuts or other attachment features coupled to the stamped sumps 204. Thus, the stamped sumps 204 may replace the mounting standoffs 320 for mounting the sensor mounting plate 310 to the heat shield 202.

In other implementations, the sensor mounting plate 310, mounting standoffs 320, and/or heat shield 202 may form a single construction component that may be attached to an outer body of the aftertreatment system 200. The mounting standoffs 320 and/or stamped sumps 204 with welded nuts may poke-yoke the design to prevent rotation of the sensor mounting table 300 relative to the aftertreatment system 200.

The first implementation of the sensor mounting table 300 may combine one or more sensors and wiring from the DPF 210, decomposition reaction chamber or pipe 220, and the SCR catalyst 230 into a single mounting solution. The sensor mounting table 300 may include a DPF/SCR combined EGTS, a DPF DP sensor, an outlet $NO_x$ sensor, and/or a PM sensor, along with the combined wiring harness for a urea injection module and the sensors. The design may minimize the quantity of stampings to potentially a single stamping. In addition, the integrated insulation design may allow for a lower profile for the first implementation of the sensor mounting table 300. The predetermined integrated wiring management and sensor orientation may assist in protecting the sensors from damage by providing a predictable orientation and configuration for the sensor mounting table 300. The sensor mounting table 300 may also provide a low profile solution to sensor mounting and cooling that packages a whole system of sensors for the aftertreatment system 200 while shielding the sensors from heat. Such a low profile may permit better integration to third-party systems, which may reduce the need for permitting rotation or clocking of the sensor table 300 relative to the aftertreatment system 200. Such a single sensor mounting table 300 may allow the sensor systems to be easily up fit with all required sensors and the gap 390 and/or insulation 392 between the sensor mounting table 300 and the heat shield 202 of the aftertreatment system 200 may reduce the direct heat path to lower heat transfer to the sensors while making the sensor mounting table 300 more easily packaged into a vehicle chassis.

For instance, as shown in FIG. 7, the sensor mounting plate 310 of the sensor mounting table 300 is mounted, via one or more mounting standoffs 320, to the heat shield 202. As shown, the heat shield 202 may be coupled to an outer body of the aftertreatment system 200 and have a first layer of insulation provided between the outer body of the aftertreatment system 200 and the heat shield 202. Mounting standoffs 320 may be attached to the heat shield 202 (e.g., via welding) or may be coupled via an attachment member, such as a bolt, screw, etc. When the sensor mounting table 300 is positioned to be attached to aftertreatment system, such as via the mounting standoffs 320 and/or the construction of the sensor mounting table 300, a channel or a gap 390 is defined between the sensor mounting plate 310 and the heat shield 202. In some implementations, the air of the channel or gap 390 may reduce the heat transfer from the heat shield 202 to the sensor mounting table 300, thus reducing the heat transfer to any sensors mounted to the sensor mounting table 300. In some implementations, insulative material 392 is positioned between a bottom surface of the substantially flat mounting surface 312 of the sensor mounting plate 310 and the heat shield 202. The insulative material 392 may further reduce the heat transfer from the heat shield 202 to the sensor mounting table 300 and/or any sensors mounted thereto.

Figure 8:
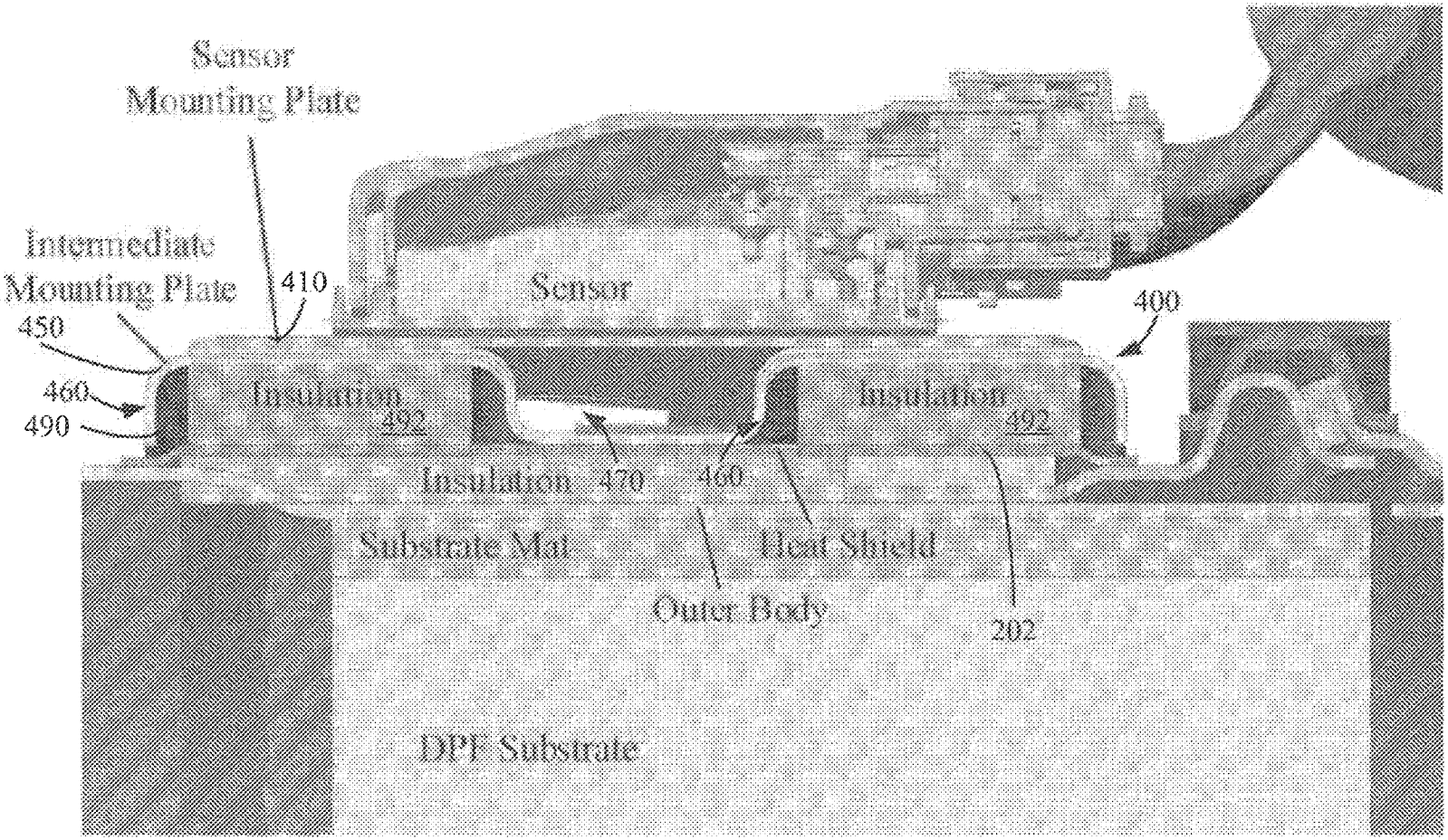
FIG. 8 depicts a cross-sectional elevation view of another implementation of a sensor mounting table mounted to a single unit aftertreatment system.
Figure 9:
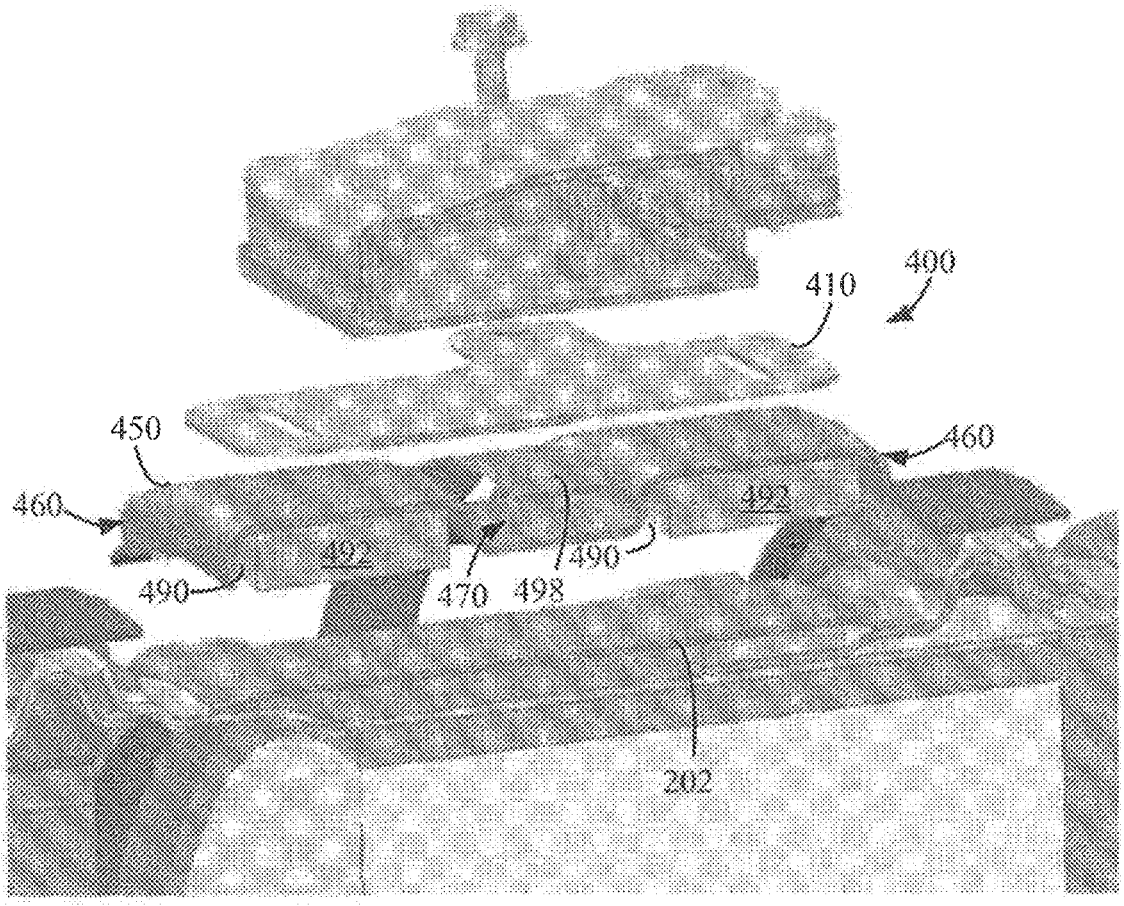
FIG. 9 depicts a cross-section exploded perspective view of the sensor mounting table of FIG. 8.

FIGS. 8-9 depict a second implementation of a sensor mounting table 400 for mounting the sensors and wiring from the DPF, decomposition reaction chamber or pipe, and the SCR catalyst to the aftertreatment system 200. The sensors may include a DPF/SCR combined EGTS, a DPF DP sensor, an outlet $NO_x$ sensor, and/or a PM sensor, along with a combined wiring harness. In the second implementation shown in FIGS. 8-9, an intermediate arcuate plate 450 may be positioned between a sensor mounting plate 410 and the heat shield 202 of the aftertreatment system 200. The intermediate arcuate plate 450 may include one or more arcuate channels 460. The one or more arcuate channels 460 may form a gap 490 which can have air and/or may include insulation 492 between the heat shield 202 and the intermediate arcuate plate 450. In some implementations, the insulation 492 may include fiberglass insulation that is attached (e.g., glued) to the intermediate arcuate plate 450 in the one or more arcuate channels 460. In some implementations, the intermediate arcuate plate 450 may be a single sheet metal stamping. The intermediate arcuate plate 450 may further include a clamp channel 470. In some implementations, the clamp channel 470 may be defined by two or more arcuate channels 460. The intermediate arcuate plate 450 may be configured to be attached to the aftertreatment system 200 via a hand clamp 498 and the clamp channel 470, such as by wrapping the band clamp 498 about the intermediate mounting plate 450 and the portion of the aftertreatment system 200 to which the sensor mounting table 400 is to be attached. Once the intermediate arcuate plate 450 is attached to the aftertreatment system 200, then the sensor mounting plate 410 may be attached (e.g., bolted, welded, etc.) to the intermediate arcuate plate 410. The sensor mounting plate 410 may have a substantially flat mounting surface for mounting one or more sensors. The one or more sensors may be mounted to the sensor mounting plate 410.

Figure 10:
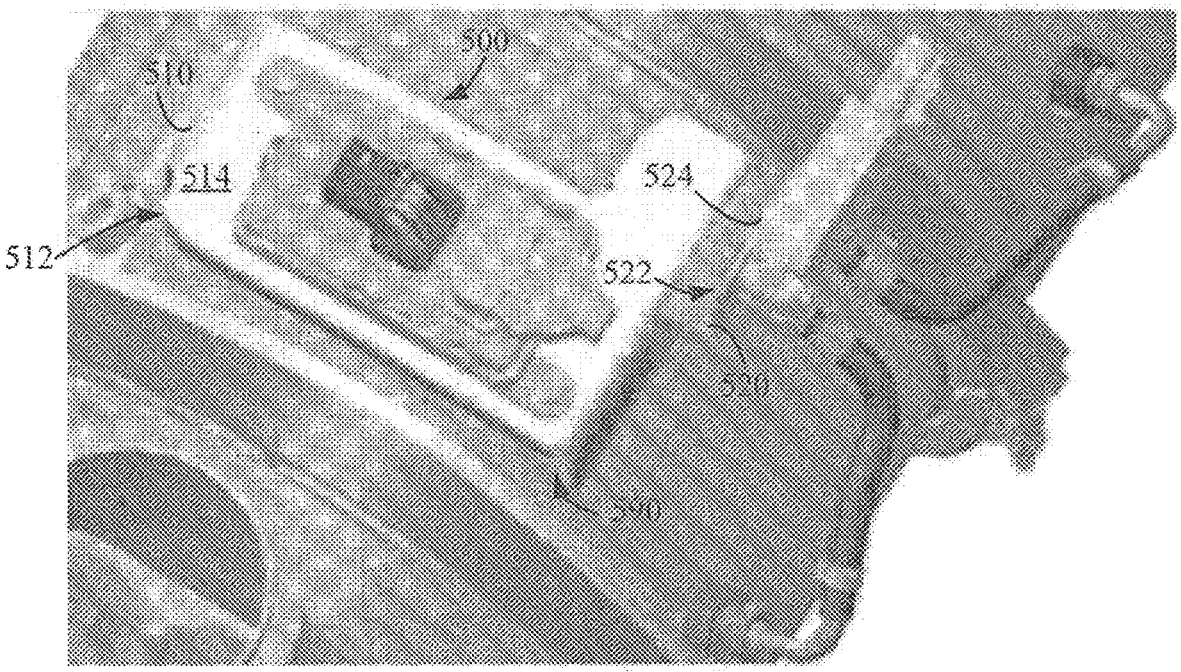
FIG. 10 depicts an implementation of a dual sensor mounting table design with two stamped tables welded to the aftertreatment system.
Figure 11:
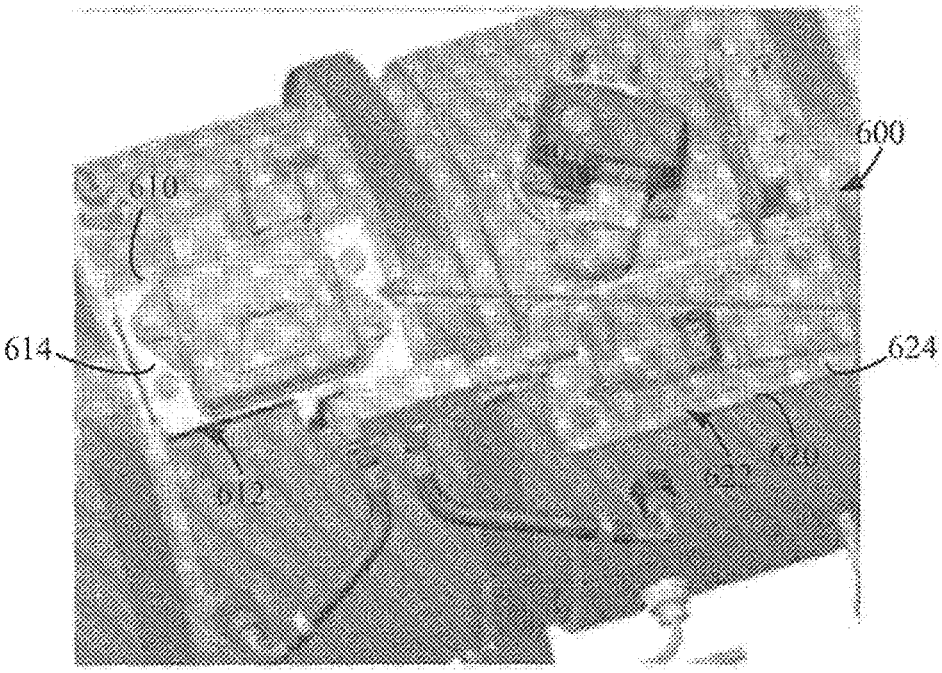
FIG. 11 depicts another implementation of a dual sensor mounting table design with two stamped tables bolted to the aftertreatment system.

FIG. 10 depicts an implementation of a dual sensor mounting table design 500 with two stamped sensor mounting tables 510, 520 welded to the aftertreatment system 200. The dual sensor mounting tables 510, 520 may be used for mounting the sensors and wiring from the DPF, decomposition reaction chamber or pipe, and the SCR catalyst to the aftertreatment system 200. The sensors may include a DPF/SCR combined EGTS, a DPF DP sensor, an outlet $NO_x$ sensor, and/or a PM sensor, along with a combined wiring harness. The dual sensor mounting tables 510, 520 each include a sensor mounting plate 512, 522 having a substantially flat mounting surface 514, 524 for mounting one or more sensors. The substantially flat mounting surface 514, 524 of each sensor mounting plate 512, 522 may be offset from the heat shield 202 of the aftertreatment system 200 to form a gap or insulation channel 590 therebetween. In some implementations, an insulative material may be disposed between at least a portion of a sensor mounting plate 512, 522 and the heat shield 202. The sensor mounting plates 512, 522 may be configured to be attached to the aftertreatment system 200 to secure the insulative material between the sensor mounting plates 512, 522 and the heat shield 202. For instance, each sensor mounting plate 512, 522 may be welded directly to a heat shield 202 of the aftertreatment system 200. The sensor mounting plates 512, 522 provide a substantially flat surface 514, 524 instead of a curved surface of the aftertreatment system 200 for mounting the one or more sensors.

In some implementations, each sensor mounting plate 512, 522 may be a single sheet metal stamping having one or more 90 degree bends to form a channel or a gap 590 between the sensor mounting plate 512, 522 and the heat shield 202, which may house integrated insulation between the sensor mounting plate 512, 522 and the heat shield 202. The 90 degree bends may be substantially perpendicular to the substantially flat mounting surface 514, 524 such that the one or more 90 degree bends secure the insulative material between each sensor mounting plate 512, 522 and the heat shield 202 in at least one direction. In some implementations, the stamping ma be optimized for sensor mounting and wire routing.

FIGS. 11-14 depict a second implementation of a dual sensor mounting table design 600 with two stamped sensor mounting tables 610, 620 bolted to the aftertreatment system 200. The dual sensor mounting tables 610, 620 may be used for mounting the sensors and wiring from the DPF, decomposition reaction chamber or pipe, and the SCR catalyst to the aftertreatment system 200. The sensors may include a DPF/SCR combined EGTS, a DPF DP sensor, an outlet $NO_x$ sensor, and/or a PM sensor, along with a combined wiring harness. The dual sensor mounting tables 610, 620 each include a sensor mounting plate 612, 622 having a substantially flat mounting surface 614, 624 for mounting one or more sensors. The sensor mounting plates 612, 622 provide a substantially flat surface 614, 624 instead of a curved surface of the aftertreatment system 200 for mounting the one or more sensors. A first sensor mounting table 612 may house the DPF DP sensor and the PM sensor while a second sensor mounting table 622 may house the DPF/SCR combined EGTS and the outlet $NO_x$ sensor.

Figure 13:
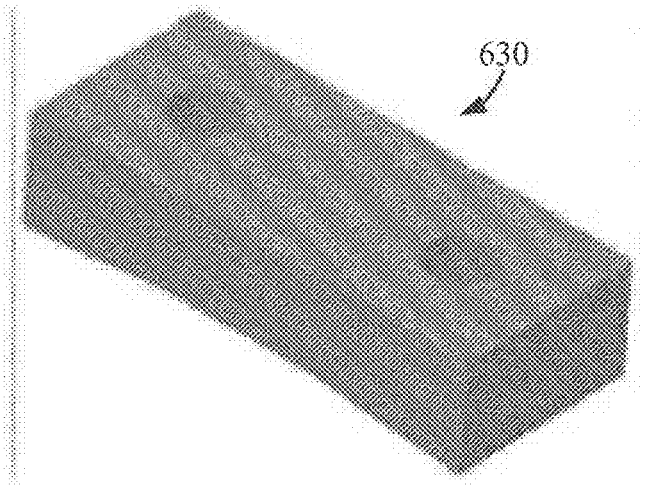
FIG. 13 depicts an implementation of a standoff for mounting the dual sensor mounting table of FIG. 11.
Figure 14:
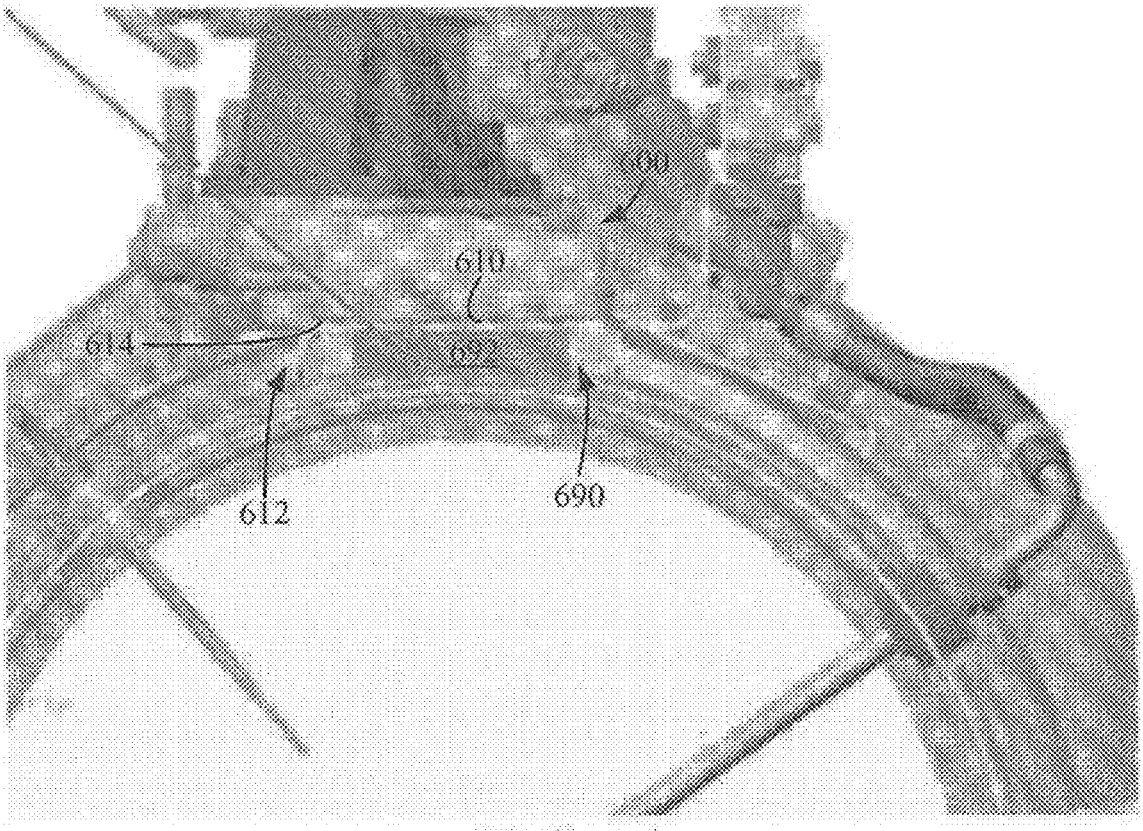
FIG. 14 depicts a front elevation view of a dual sensor mounting table design mounted to an aftertreatment system.

The substantially flat mounting surface 614, 624 of each sensor mounting plate 612, 622 may be offset from the heat shield 202 of the aftertreatment system 200 to form a gap or insulation channel 690 therebetween. In some implementations, an insulative material 692 may be disposed between at least a portion of a sensor mounting plate 612, 622 and the heat shield 202. The sensor mounting plates 612, 622 may be configured to be attached to the aftertreatment system 200 to secure the insulative material 692 between the sensor mounting plate 612, 622 and the heat shield 202. For instance, each sensor mounting plate 612, 622 may be attached (e.g., bolted to a sump of the heat shield 202 or a welded threaded standoff 630, welded, etc.) directly to a heat shield 202 of the aftertreatment system 200. A length of a standoff 630, such as shown in FIG. 13, may be increased or decreased to provide proper mounting and/or to avoid an overhang of the sensor mounting plates 612, 622.

Figure 12:
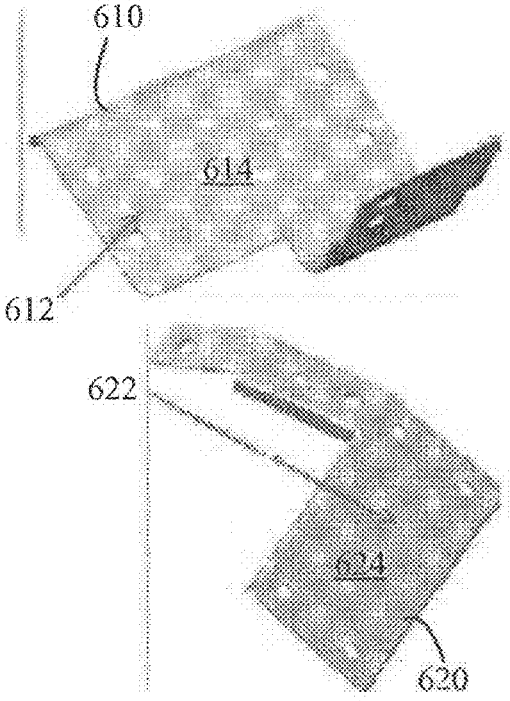
FIG. 12 depicts perspective views of two brackets for the dual sensor mounting table of FIG. 11 having a substantially flat mounting surface for one or more sensors.

In some implementations, each sensor mounting plate 612, 622, such as those shown in FIG. 12, may be a single sheet metal stamping having one or more 90 degree bends to form a channel or a gap 690 between the sensor mounting plate 612, 622 and the heat shield 202, which may house integrated insulation 692 between the sensor mounting plate 612, 622 and the heat shield 202. The 90 degree bends may be substantially perpendicular to the substantially flat mounting surface 614, 624 such that the one or more 90 degree bends secure the insulative material 692 between each sensor mounting plate 612, 622 and the heat shield 202 in at least one direction. In some implementations, the stamping may be optimized for sensor mounting and wire routing.

The aforementioned sensor mounting tables may permit the entire sensor mounting system and/or a portion thereof (such as in the dual sensor mounting table concepts disclosed) to be easily removable from the aftertreatment system for replacing or repairing one or more sensors, upgrading one or more sensors, and/or removing one or more sensors. Such integrated solutions may minimize the quantity of stampings to potentially a single stamping or two stampings. In addition, the integrated insulation design for the one or more sensor mounting tables may allow for a lower profile. Such a low profile may permit better integration to third-party systems, which may reduce the need for permitting rotation or clocking of each sensor mounting table relative to the aftertreatment system. The predetermined integrated wiring management and sensor orientation may also assist in protecting the sensors from damage by providing a predictable orientation and configuration for each sensor mounting table. The sensor systems may also be easily up fit with all required sensors and the gap and/or insulation between the sensor mounting table and the heat shield of the aftertreatment system may reduce the direct heat path to lower heat transfer to the sensors while making the sensor mounting table more easily packaged into a vehicle chassis.

The term "controller" encompasses all kinds of apparatus, devices, and machines for processing data, including by way of example a programmable processor, a computer, a system on a chip, or multiple ones, a portion of a programmed processor, or combinations of the foregoing. The apparatus can include special purpose logic circuitry, e.g., an FPGA or an ASIC. The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as distributed computing and grid computing infrastructures.

While this specification contains many specific implementation details, these should not be construed as limitations on the scope of the disclosure, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially disclosed as such, one or more features from one combination can in some cases be excised from the combination, and the combination may be directed to a subcombination or variation of a subcombination.

As utilized herein, the terms "substantially", "about," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described without restricting the scope of these features to the precise numerical ranges provided. Accordingly, these terms should be interpreted as indicating that insubstantial or inconsequential modifications or alterations of the subject matter described are considered to be within the scope of the invention as recited herein. Additionally, it is noted that limitations in the concepts should not be interpreted as constituting "means plus function" limitations under the United States patent laws in the event that the term "means" is not used therein.

The terms "coupled," "connected," and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

It is important to note that the construction and arrangement of the system shown in the various exemplary implementations is illustrative only and not restrictive in character. All changes and modifications that come within the spirit and/or scope of the described implementations are desired to be protected. It should be understood that some features may not be necessary and implementations lacking the various features may be contemplated as within the scope of the application. In reading the concepts, it is intended that when words such as "a," "an," "at least one," or "at least one portion" are used there is no intention to limit the concept to only one item unless specifically stated to the contrary in the concept. When the language "at least a portion" and/or "a portion" is used the item can include a portion and/or the entire item unless specifically stated to the contrary.

What is claimed is:

1. A sensor mounting system comprising:

a first sensor mounting plate configured to be mounted to an aftertreatment system, the first sensor mounting plate comprising a first substantially flat mounting surface for mounting a first sensor; and a second sensor mounting plate configured to be mounted to the aftertreatment system, the second sensor mounting plate comprising a second substantially flat mounting surface for mounting a second sensor, wherein the second sensor mounting plate is attached to the first sensor mounting plate, wherein the first sensor mounting plate further comprises a first bend portion extending substantially perpendicular to the first substantially flat mounting surface;

wherein the second sensor mounting plate is attached to the first sensor mounting plate via the first bend portion;

wherein the first sensor mounting plate further comprises additional bend portions extending substantially perpendicular to the first substantially flat mounting surface; and wherein the additional bend portions are not attached to the second sensor mounting plate.

2. The sensor mounting system of claim 1, wherein the first bend portion forms a channel between the first sensor mounting plate and a heat shield of the aftertreatment system.

3. The sensor mounting system of claim 1, wherein the first sensor mounting plate and the second sensor mounting plate each comprise a single sheet stamped metal.

4. The sensor mounting system of claim 1, wherein the first substantially flat mounting surface is substantially perpendicular to the second substantially flat mounting surface.

5. The sensor mounting system of claim 1, wherein the second sensor mounting plate further comprises a second bend portion extending substantially perpendicular to the second substantially flat mounting surface, wherein the second bend portion is substantially parallel to the first substantially flat mounting surface.

6. The sensor mounting system of claim 1, wherein the first sensor mounting plate is substantially L-shaped.

7. The sensor mounting system of claim 1, wherein the first sensor mounting plate is directly welded to a heat shield of the aftertreatment system.

8. A sensor mounting system comprising:

a first sensor mounting plate configured to be mounted to an aftertreatment system, the first sensor mounting plate comprising a first substantially flat mounting surface for mounting a first sensor; and a second sensor mounting plate configured to be mounted to the aftertreatment system, the second sensor mounting plate comprising a second substantially flat mounting surface for mounting a second sensor, wherein the second sensor mounting plate is attached to the first sensor mounting plate;

wherein the second sensor mounting plate further comprises a first bend portion extending substantially perpendicular to the second substantially flat mounting surface;

wherein the first bend portion is substantially parallel to the first substantially flat mounting surface; and wherein the second sensor mounting plate further comprises a second bend portion extending substantially perpendicular to the first bend portion and towards the first substantially flat mounting surface.

9. A sensor mounting system comprising:

a first sensor mounting plate configured to be mounted to an aftertreatment system, the first sensor mounting plate comprising a first substantially flat mounting surface for mounting a first sensor; and a second sensor mounting plate configured to be mounted to the aftertreatment system, the second sensor mounting plate comprising a second substantially flat mounting surface for mounting a second sensor, wherein the second sensor mounting plate is attached to the first sensor mounting plate;

wherein the second sensor mounting plate further comprises a first bend portion extending substantially perpendicular to the second substantially flat mounting surface;

wherein the first bend portion is substantially parallel to the first substantially flat mounting surface;

wherein the second sensor mounting plate further comprises a second bend portion extending substantially perpendicular to the first bend portion and towards the first substantially flat mounting surface; and wherein the second sensor mounting plate is attached to the first sensor mounting plate via the second bend portion.

* * * * *